US009121283B2

(12) United States Patent
Feigleson et al.

(10) Patent No.: US 9,121,283 B2
(45) Date of Patent: Sep. 1, 2015

(54) ASSEMBLY FIXTURE WITH WEDGE CLAMPS FOR STATOR VANE ASSEMBLY

(71) Applicants: Steven J. Feigleson, Falmouth, ME (US); Dennis R. Tremblay, Biddeford, ME (US)

(72) Inventors: Steven J. Feigleson, Falmouth, ME (US); Dennis R. Tremblay, Biddeford, ME (US)

(73) Assignee: United Technologies Corporation, Hartford, CT (US)

( * ) Notice: Subject to any disclaimer, the term of this patent is extended or adjusted under 35 U.S.C. 154(b) by 525 days.

(21) Appl. No.: 13/622,174

(22) Filed: Sep. 18, 2012

(65) Prior Publication Data

US 2013/0014389 A1 Jan. 17, 2013

Related U.S. Application Data

(63) Continuation-in-part of application No. 13/010,174, filed on Jan. 20, 2011, now Pat. No. 8,966,756, and a continuation-in-part of application No. 13/483,501, filed on May 30, 2012, now Pat. No. 8,966,755.

(51) Int. Cl.
*F01D 25/28* (2006.01)
*F01D 9/04* (2006.01)

(52) U.S. Cl.
CPC ..... *F01D 9/04* (2013.01); *F01D 25/285* (2013.01); *F05D 2230/60* (2013.01); *F05D 2240/10* (2013.01); *F05D 2240/55* (2013.01); *Y10T 29/49323* (2015.01)

(58) Field of Classification Search
CPC ... F01D 25/285; F01D 9/04; Y10T 29/49323; F05D 2230/64; F05D 2230/644
See application file for complete search history.

(56) References Cited

U.S. PATENT DOCUMENTS

| | | | |
|---|---|---|---|
| 5,232,340 | A | 8/1993 | Morgan |
| 5,281,089 | A | 1/1994 | Brown et al. |
| 5,380,155 | A | 1/1995 | Varsik et al. |
| 5,494,404 | A | 2/1996 | Furseth et al. |
| 5,547,342 | A | 8/1996 | Furseth et al. |
| 6,202,302 | B1 | 3/2001 | Descoteaux |
| 6,409,472 | B1 | 6/2002 | McMahon et al. |
| 6,425,736 | B1 | 7/2002 | McMahon et al. |
| 6,543,995 | B1 | 4/2003 | Honda et al. |
| 6,910,859 | B2 | 6/2005 | Bluhm et al. |
| 7,413,400 | B2 | 8/2008 | Barnett |
| 7,494,316 | B2 | 2/2009 | Barnett et al. |
| 7,637,718 | B2 | 12/2009 | Barnett et al. |
| 2010/0166545 | A1 | 7/2010 | Schuler et al. |
| 2010/0272565 | A1 | 10/2010 | Cheung |

*Primary Examiner* — Nathaniel Wiehe
*Assistant Examiner* — Jeffrey A Brownson
(74) *Attorney, Agent, or Firm* — O'Shea Getz P.C.

(57) ABSTRACT

A fixture for assembling a stator vane assembly of a gas turbine engine includes a base which defines a multiple of locators to position each of a multiple of vanes relative to an outer fairing and an inner fairing. A first tangential wedge clamp is receivable in a first aperture located within the base for each of the multiple of vanes. A second tangential wedge clamp is receivable in a second aperture located within the base for each of the multiple of vanes.

17 Claims, 10 Drawing Sheets

ASSEMBLY FIXTURE WITH WEDGE CLAMPS FOR STATOR VANE ASSEMBLY

CROSS REFERENCE TO RELATED APPLICATION

This application is a continuation-in-part of U.S. patent application Ser. No. 13/010,174 filed on Jan. 20, 2011, and Ser. No. 13/483,501 filed May 30, 2012.

BACKGROUND

A gas turbine engine typically includes a fan section, and a core engine with a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Some compressor sections may include a front architecture with a stator vane assembly that supports stator vanes relative to inner and outer fairings with a rubber potting. As there may be no mechanical fasteners that secure the vanes within the fairings, assembly may be relatively difficult and time consuming. Current assembly tools may be relatively delicate in that but little pressure on vane ends may move the vane off of the fixture such that the vanes may tend to lift from the fixture. This may effect accurate location of the vanes within the stator vane assembly and thus the front architecture.

SUMMARY

A fixture for assembling a stator vane assembly of a gas turbine engine according to one disclosed non-limiting embodiment of the present disclosure includes a base which defines a multiple of locators to position each of a multiple of vanes relative to an outer fairing and an inner fairing, a first tangential wedge clamp receivable in a first aperture located within the base for each the multiple of vanes, and a second tangential wedge clamp receivable in a second aperture located within the base for each of the multiple of vanes.

In a further embodiment of the foregoing embodiment, the base defines a first locator plane, a second locator plane and a third locator plane for each of the multiple of vanes.

In a further embodiment of any of the foregoing embodiments, the base defines a first plane with at least (3) contact points, a second plane with at least two (2) contact points and a third plane with at least one (1) contact point.

In a further embodiment of any of the foregoing embodiments, the first tangential wedge clamp and the second tangential wedge clamp for each vane includes a frustoconical portion.

In a further embodiment of any of the foregoing embodiments, the first tangential wedge clamp and the second tangential wedge clamp for each vane includes a cylindrical portion receivable within the respective first and second apertures.

In a further embodiment of any of the foregoing embodiments, the first tangential wedge clamp and the second tangential wedge clamp flank a locator for each vane. In the alternative or additionally thereto, the foregoing embodiment includes the locator receives an axial wedge clamp. In the alternative or additionally thereto, the foregoing embodiment includes a fastener receivable within the locator to bias the axial wedge clamp toward the locator.

In a further embodiment of any of the foregoing embodiments, the first tangential wedge clamp and the second tangential wedge clamp includes a handle offset from an axis defined by a frustroconical portion.

A method of assembling a stator vane assembly of a gas turbine engine, according to another disclosed non-limiting embodiment of the present disclosure includes positioning each of a multiple of vanes relative to an outer fairing and an inner fairing on a base which defines a multiple of locator planes, receiving a first tangential wedge clamp in a first aperture located within the base for each of the multiple of vanes, and receiving a second tangential wedge clamp in a second aperture located within the base for each of the multiple of vanes.

In a further embodiment of the foregoing embodiment, positioning each of the multiple vanes within a slot in the inner and outer fairing. In the alternative or additionally thereto, the foregoing embodiment includes injecting a curable material in each of the slots.

In a further embodiment of any of the foregoing embodiments, defining a first locator plane, a second locator plane and a third locator plane for each of the multiple of vanes.

In a further embodiment of any of the foregoing embodiments, defining a first locator plane with at least three (3) contact points, a second locator plane with at least two (2) contact points and a third locator plane with at least one (1) contact point.

In a further embodiment of any of the foregoing embodiments, defining a first tangential locator plane with at least three (3) contact points, a second axial locator plane with at least two (2) contact points and a third radial locator plane with at least one (1) contact point.

In a further embodiment of any of the foregoing embodiments, receiving the first tangential wedge clamp in the first aperture for each of the multiple of vanes such that the first tangential web clamp abuts one of the multiple of vanes and receiving the second tangential wedge clamp in the second aperture for each of the multiple of vanes such that the second tangential web clamp abuts the one of the multiple of vanes.

In a further embodiment of any of the foregoing embodiments, axially receiving the first tangential wedge clamp in the first aperture for each of the multiple of vanes such that the first tangential web clamp abuts one of the multiple of vanes and axially receiving the second tangential wedge clamp in the second aperture for each of the multiple of vanes such that the second tangential web clamp abuts the one of the multiple of vanes.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
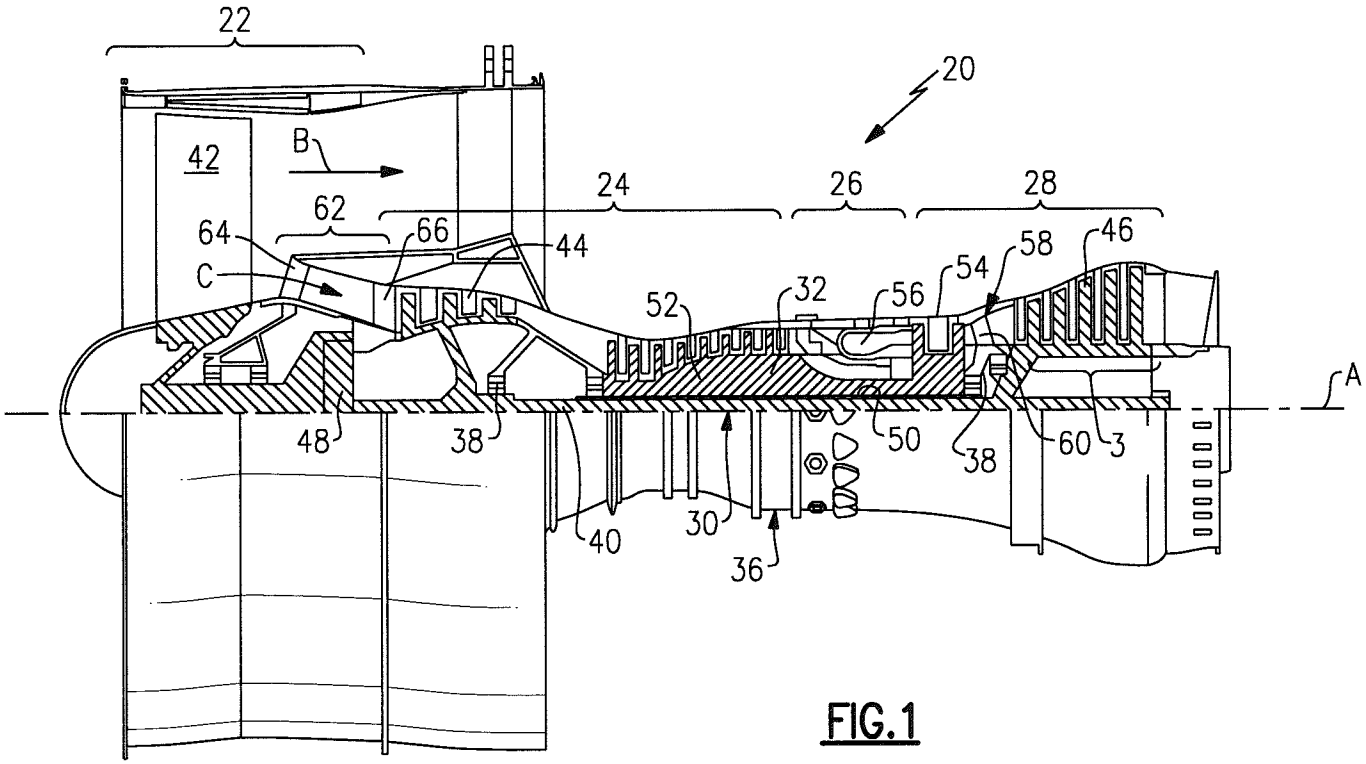
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although depicted as a turbofan gas turbine engine in the disclosed non-limiting embodiment, it should be understood that the concepts described herein are not limited to use with turbofans as the teachings may be applied to other types of turbine engines such as a three-spool (plus fan) engine wherein an intermediate spool includes an intermediate pressure compressor (IPC) between the LPC and HPC and an intermediate pressure turbine (IPT) between the HPT and LPT.

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed with the fuel and burned in the combustor 56, then expanded over the high pressure turbine 54 and low pressure turbine 46. The turbines 54, 46 rotationally drive the respective low spool 30 and high spool 32 in response to the expansion.

The main engine shafts 40, 50 are supported at a plurality of points by bearing structures 38 within the static structure 36. It should be understood that various bearing structures 38 at various locations may alternatively or additionally be provided.

In one non-limiting example, the gas turbine engine 20 is a high-bypass geared aircraft engine. In a further example, the gas turbine engine 20 bypass ratio is greater than about six (6:1). The geared architecture 48 can include an epicyclic gear train, such as a planetary gear system or other gear system. The example epicyclic gear train has a gear reduction ratio of greater than about 2.3, and in another example is greater than about 2.5:1. The geared turbofan enables operation of the low spool 30 at higher speeds which can increase the operational efficiency of the low pressure compressor 44 and low pressure turbine 46 and render increased pressure in a fewer number of stages.

A pressure ratio associated with the low pressure turbine 46 is pressure measured prior to the inlet of the low pressure turbine 46 as related to the pressure at the outlet of the low pressure turbine 46 prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 44, and the low pressure turbine 46 has a pressure ratio that is greater than about five (5:1). It should be understood, however, that the above parameters are only exemplary of one embodiment of a geared architecture engine and that the present disclosure is applicable to other gas turbine engines including direct drive turbofans.

In one embodiment, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of "T"/518.70.5. in which "T" represents the ambient temperature in degrees Rankine. The Low Corrected Fan Tip Speed according to one non-limiting embodiment of the example gas turbine engine 20 is less than about 1150 fps (351 m/s).

The gas turbine engine 20 includes a front architecture 62 with a plurality of stator vanes 64. The plurality of stator vanes 64 are disposed aft of the fan blades 42 within an inlet for the core engine flow C. The plurality of stator vanes 64 are arranged circumferentially forward of a plurality of inlet guide vanes 66.

Figure 2:
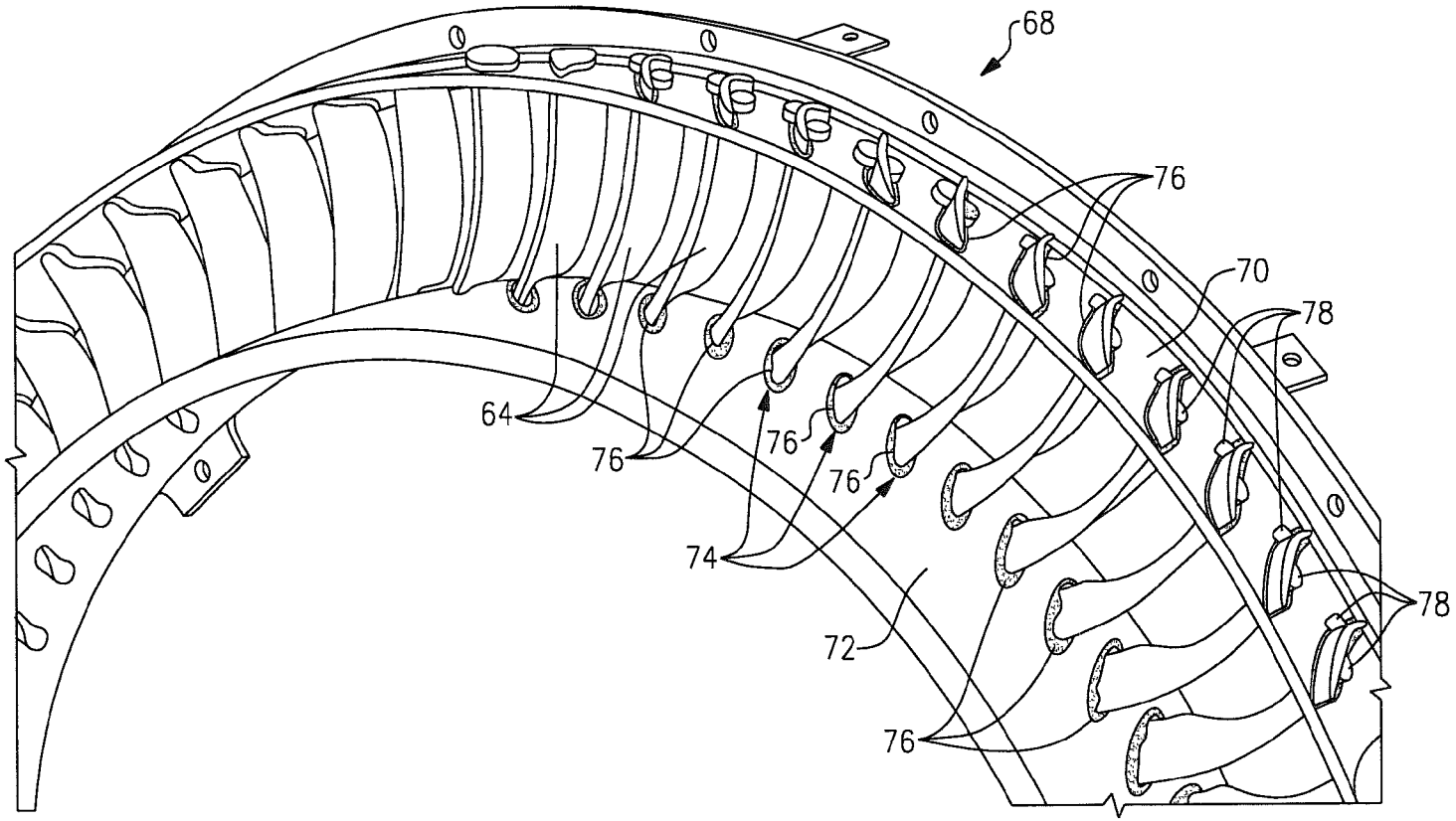
FIG. 2 is a perspective view of a stator vane assembly.

With reference to FIG. 2, the stator vanes 64 extend between an outer fairing 70 and an inner fairing 72 to form a stator vane assembly 68. It should be understood that other components may alternatively or additionally be included in the stator vane assembly 68. Furthermore, any vane assembly which utilizes a bonded joint between the stator and fairings will also benefit herefrom.

Figure 3:
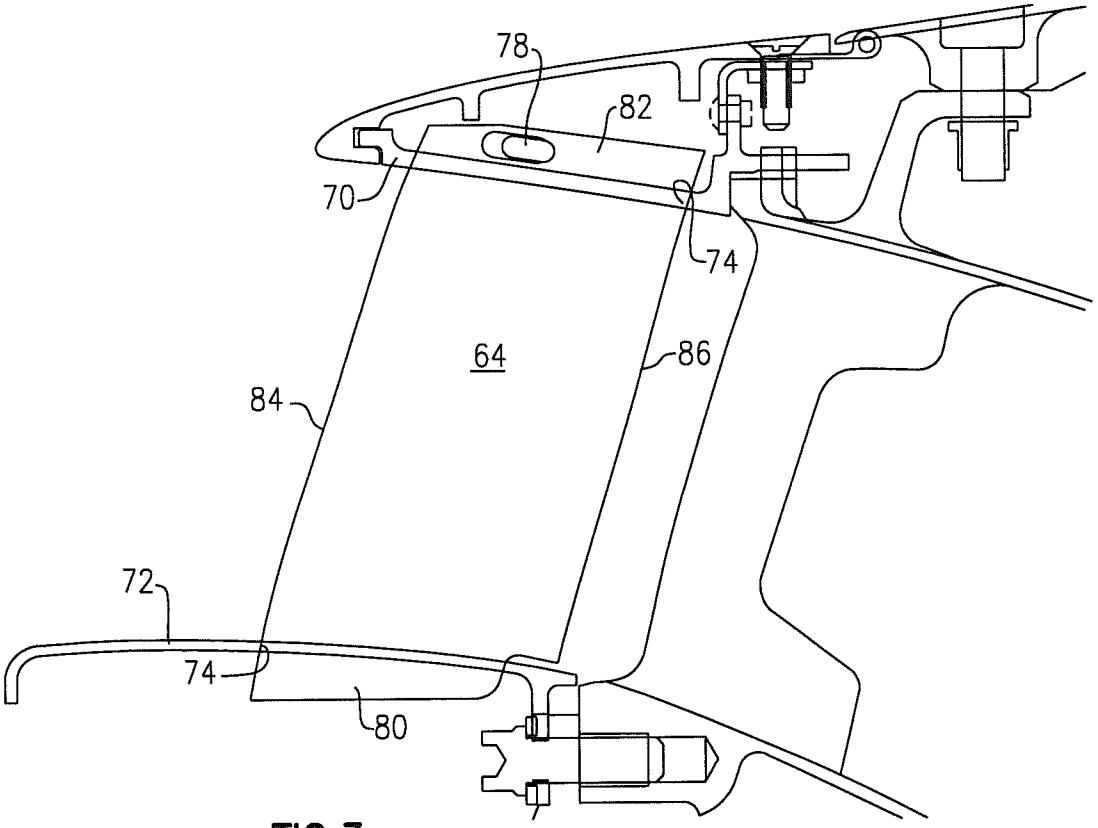
FIG. 3 is a partial schematic sectional view of a vanes of the stator vane assembly.
Figure 4:
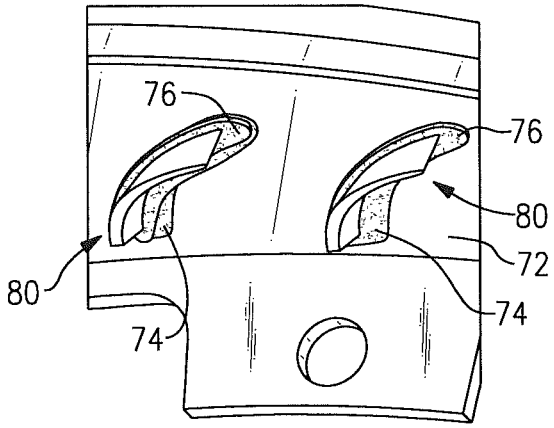
FIG. 4 is an inner view of a portion of the stator vane assembly.
Figure 5:
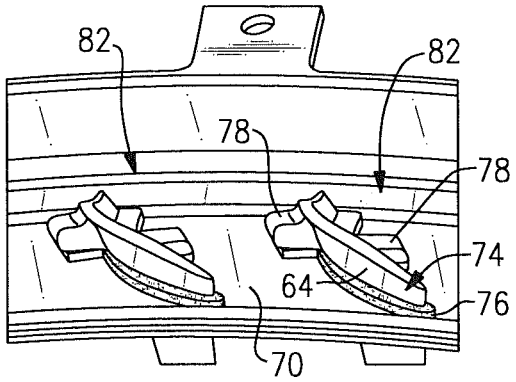
FIG. 5 is an outer view of a portion of the stator vane assembly.

With reference to FIG. 3 the stator vanes 64 are supported within openings 74 such as slots defined within each of the outer and inner fairings 70, 72. Each of the stator vanes 64 generally includes an inner end 80 (also shown in FIG. 4), an outer end 82 (also shown in FIG. 5), a leading edge 84 and a trailing edge 86. Each of the stator vanes 64 are supported within a opening 74 by a sealant 76 such as a curable material that remains flexible once cured. The sealant 76 provides a bonded joint between the outer and inner fairings 70, 72 and is injected between each of the vanes 64 and the corresponding openings 74 to vibrationally isolate the stator vanes 64 from the outer and inner fairings 70, 72.

Each of the stator vanes 64 may include a tab 78 that facilitates location of each vane 64 within the outer fairing 70, however, the sealant 76 is that which provides the joint to maintain each of the vanes 64 in a desired position relative to the other vanes 64 and each of the outer and inner fairings 70, 72. Assembly of the stator vane assembly 68 requires specific positioning of each of the vanes 64 within the respective openings 74. The openings 74 are provided such that the vanes 64 themselves do not engage the outer and inner fairings 70, 72.

Figure 6:
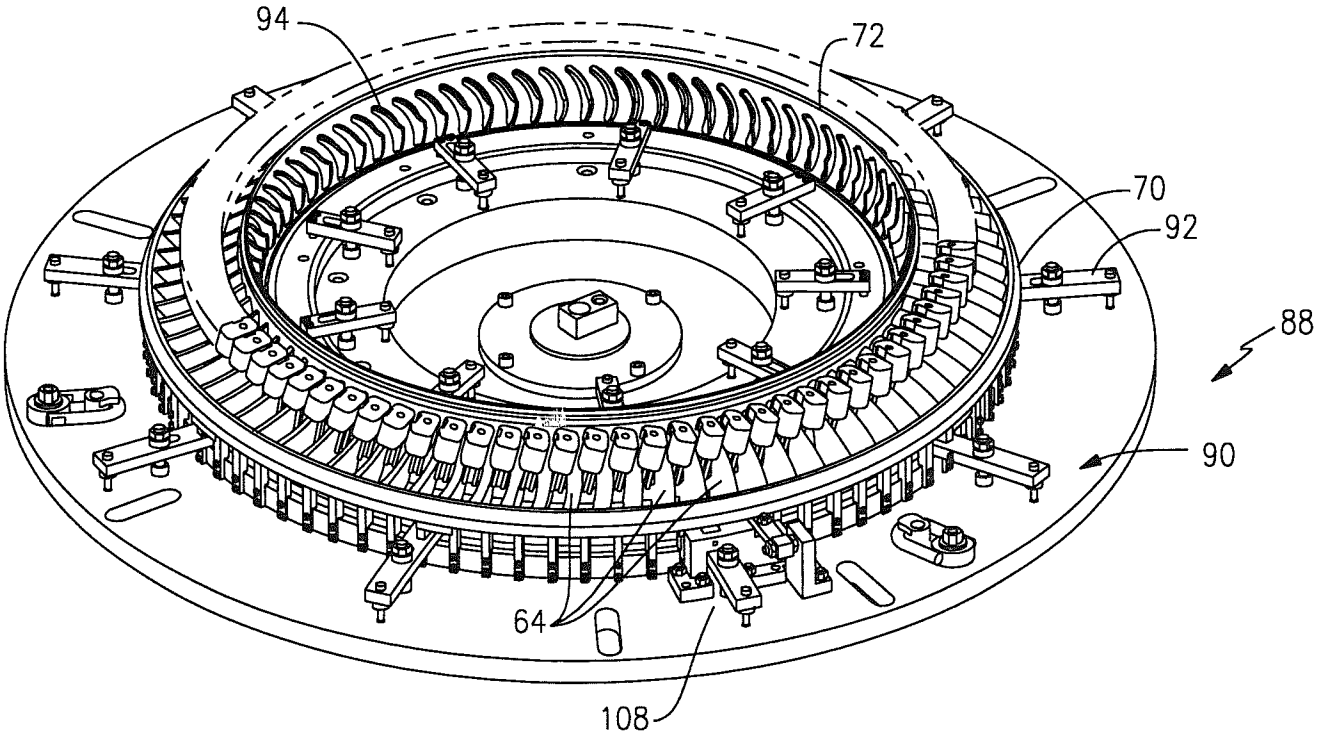
FIG. 6 is a perspective view of a fixture for assembling a stator vane assembly.

With reference to FIG. 6, an assembly fixture 88 is utilized to define and maintain a relative position between the plurality of stator vanes 64 and the outer and inner fairings 70, 72 while the sealant 76 is applied and cured to form the completed stator vane assembly 68. The assembly fixture 88 defines the specific datum planes and points required to properly align each of the plurality of vanes 64 relative to each other as well as the outer and inner and fairings 70, 72.

The assembly fixture 88 includes a base 90 that positions the outer fairing 70 and the inner fairing 72 with respective outer clamps 92 and inner clamps 94. The plurality of stator vanes 64 are each positioned with respect to the outer fairing 70 and the inner fairing 72 by the base 90 through a multiple of locators 96, 98, 100, 102, 104, 106 (FIG. 7) which extend from the base 90. The base 90 may further include other locaters such as a circumferential locator 108 that circumferentially positions the outer fairing 70 through engagement with a mount tab 70A (FIG. 3) which extends from the outer fairing 70. It should be appreciated that other features may be alternatively or additionally utilized to locate the outer fairing 70 and the inner fairing 72.

Figure 7:
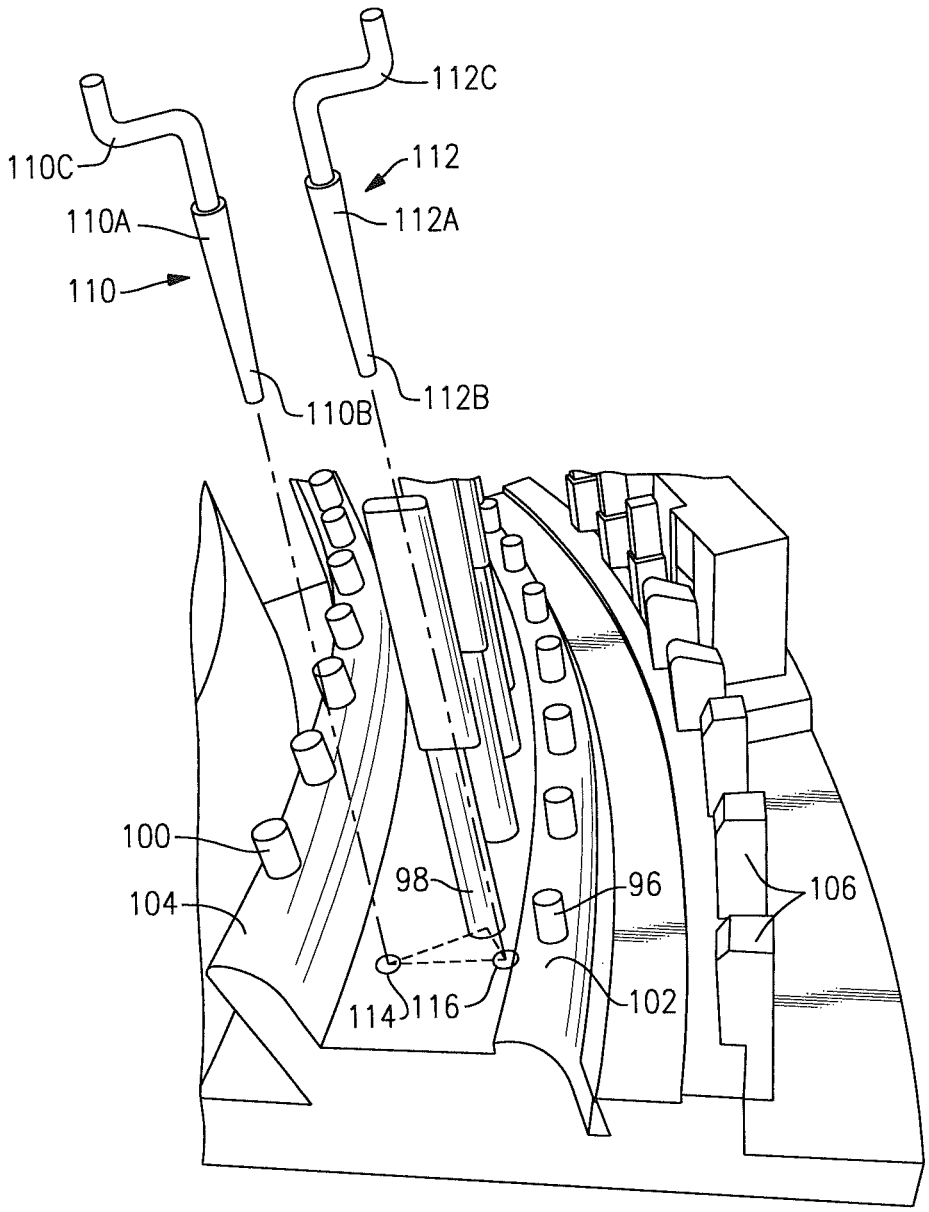
FIG. 7 is an expanded partial sectional view of the fixture with a first and second tangential wedge clamp exploded away therefrom.

With reference to FIG. 7, the locators 96-106 define three planes of location for each vane 64 relative to the fairings 70, 72. The locators 96, 98, 100 may be referred to as plane A and define a tangential location plane for the vane 64. Locators 102, 104 may be referred to as plane B and define an axial location plane for the vane 64. Locator 106 may be referred to as plane C and define a radial location plane for the vane 64.

Figure 8:
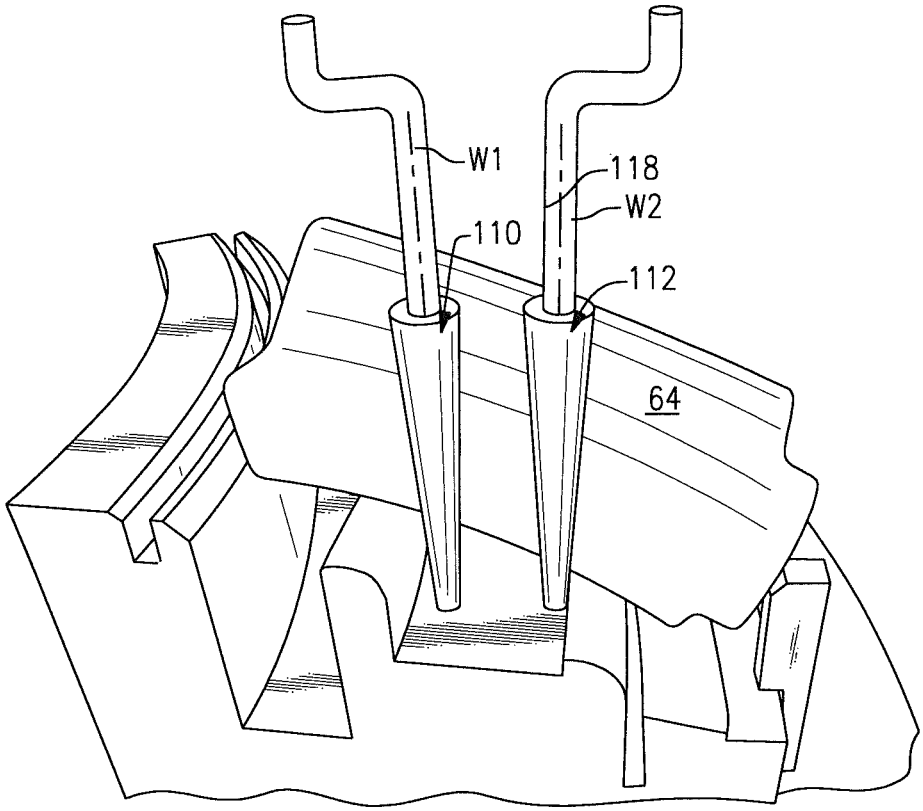
FIG. 8 is an expanded partial sectional view of the fixture with a first and second tangential wedge clamp installed adjacent to a vane.

A first tangential wedge clamp 110 and a second tangential wedge clamp 112 are receivable in a respective aperture 114, 116 located within the base 90 for each vane 64 (FIG. 8). The first and second tangential wedge clamps 110, 112 include a generally frustroconical shaped portion 110A, 112A and a cylindrical portion 110B, 112B receivable in the respective aperture 114, 116 to securely clamp each vane 64 toward the locators 96, 98, 100 to assure that the vane 64 is properly located in the tangential location plane. The largest diameter of the frustroconical shaped portion 110A, 112A is opposite the respective cylindrical portion 110B, 112B.

The apertures 114, 116 position the respective first and second tangential wedge clamps 110, 112 to flank the locator 98 and are radially inboard of locator 96 and radially outboard of the locator 100. In other words, the first and second tangential wedge clamps 110, 112 define a triangle with respect to locator 98 and are radially positioned between locators 96, 100. The first and second tangential wedge clamps 110, 112 are received within the apertures 114, 116 (FIG. 9) to hold the vane 64 securely against the locators 96, 98, 100 so as to greatly increase the amount of pressure required to move the vanes 64 and thereby assure accurate location. The first and second tangential wedge clamps 110, 112 may be received within the apertures 114, 116 with light finger pressure.

Figure 9:
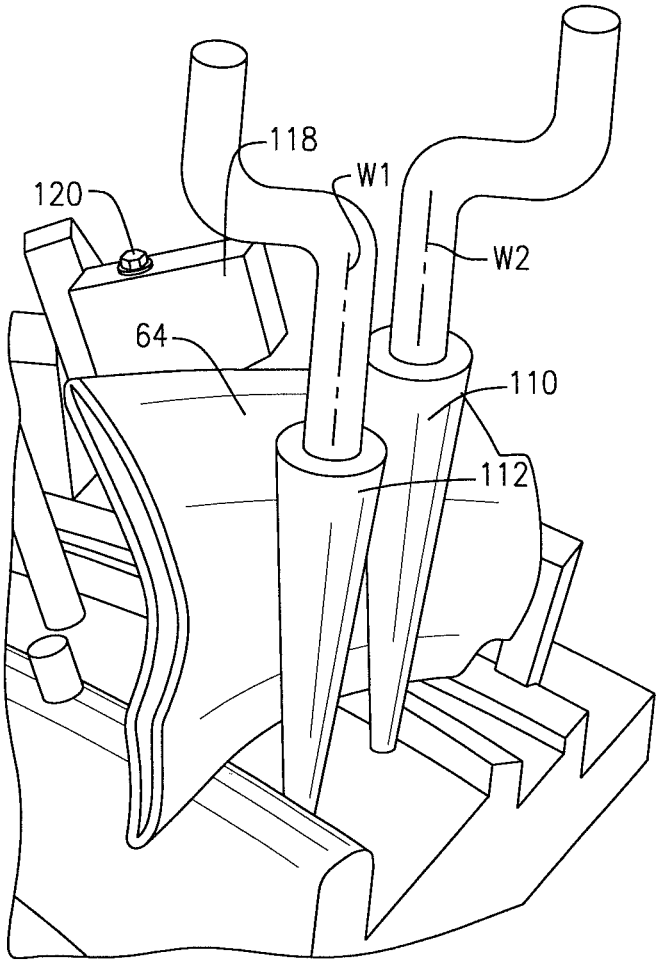
FIG. 9 is an outer perspective view of the fixture with a first and second tangential wedge clamp installed adjacent to a vane.

With reference to FIG. 9, the locators 98 each receive an axial wedge clamp 118 such as a block-shaped member. The axial wedge clamp 118 may be friction fit or receive a fastener 120 which threads into the locator 98 to bias the axial wedge clamp 118 toward the vane 64 and the vane 64 against the axial locators 102, 104. The surface of the axial wedge clamp 118 which abuts the vane 64 is cut at a slight angle so that the axial wedge clamp 118 acts both in the axial and tangential directions to hold the vane 64 against both the third tangential locator 98 and the two axial locators 102, 104.

Figure 10:
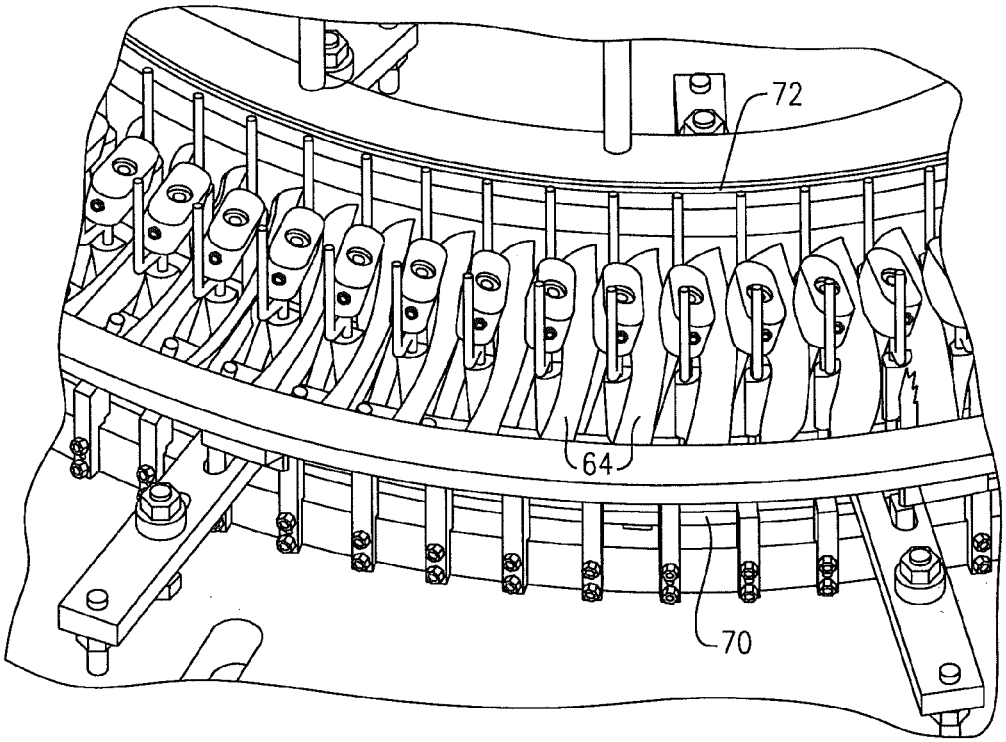
FIG. 10 is a top perspective view of the fixture with a first and second tangential wedge clamp installed adjacent to a vane.

The first and second tangential wedge clamps 110, 112 replace the conventional single tangential clamping point on each vane 64 with three points to provide greater location security through prevention of vane 64 lift off from the locators 96-106 in the stator assembly fixture 88 during the assembly process. The first and second tangential wedge clamps 110, 112 hold the vane 64 directly against two of the tangential locators 96, 100 and the axial wedge clamp 118 holds the vane against the axial locators 102, 104 and the third tangential locator 98. The first and second tangential wedge clamps 110, 112 may also include a handle portion 110C, 112C which extend from the generally frustroconical shaped portion 110A, 112A to avoid interference with the axial wedge clamp 118 yet provide operator access to facilitate proper axial position of the first and second tangential wedge clamps 110, 112 along axes W1, W2 from which the handle portions 110C, 112C may be offset (FIG. 10).

Figure 11:
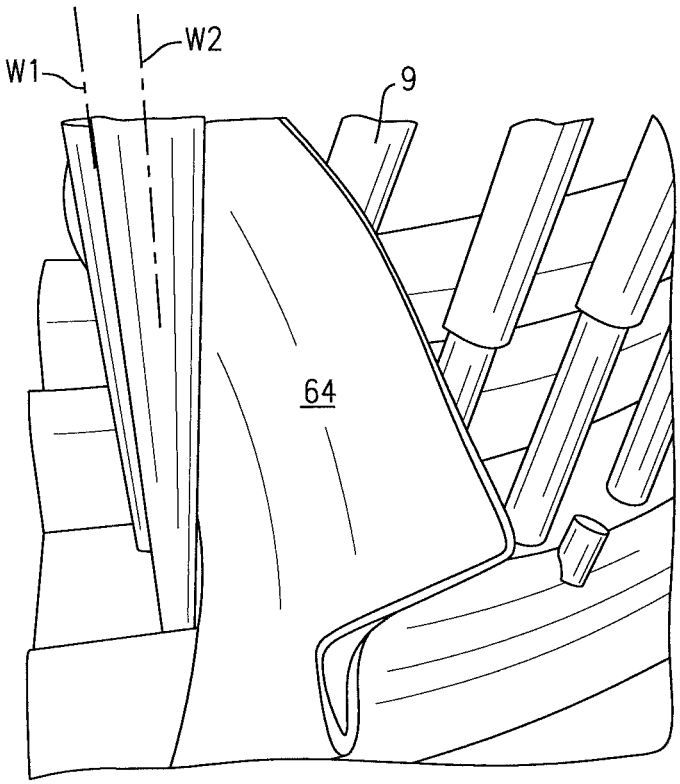
FIG. 11 is an outer perspective view of the fixture with a first and second tangential wedge clamp installed adjacent to a vane.

With reference to FIG. 11, the axial position of the first and second tangential wedge clamps 110, 112 along axes W1, W2 and the frustroconical shape thereof accommodate slight tolerance variations in each vane 64. In one disclosed non-limiting embodiment the first and second tangential wedge clamps 110, 112 facilitate location of each vane 64 to +/−0.015 inches (0.38 mm).

In an assembly operation according to one disclosed non-limiting embodiment, the assembly fixture 88 locates the relative position of the outer and inner fairings 70, 72 and are clamped to the base 90 with clamps 92, 94. The individual vanes 64 are then positioned on the assembly fixture 88 with respect to the outer and inner fairings 70, 72 through the respective opening 74 within the outer fairing 70 to the radial locator 106. Once the vanes 64 are inserted and abutted the radial locator 106, the axial wedge clamp 118 is then secured to bias and hold the vane 64 against the locators 98, 102, 104.

With each of the vanes 64 held in a desired position relative to the corresponding outer and inner fairings 70, 72, the sealant 76 is injected around each of the vanes 64 in the openings 74 of the respective outer and inner fairings 70. 72. Once the sealant 76 has properly cured the stator vane assembly 68 can be removed from the assembly fixture 88.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

The invention claimed is:

1. A fixture for assembling a stator vane assembly of a gas turbine engine comprising:

a base which defines a multiple of locators to position each of a multiple of vanes relative to an outer fairing and an inner fairing;

a first tangential wedge clamp receivable in a first aperture located within said base for each of said multiple of vanes; and a second tangential wedge clamp receivable in a second aperture located within said base for each of said multiple of vanes.

2. The fixture as recited in claim 1, wherein said base defines a first locator plane, a second locator plane and a third locator plane for each of said multiple of vanes.

3. The fixture as recited in claim 1, wherein said base defines a first plane with at least three (3) contact points, a second plane with at least two (2) contact points and a third plane with at least one (1) contact point.

4. The fixture as recited in claim 1, wherein said first tangential wedge clamp and said second tangential wedge clamp for each vane include a frustoconical portion.

5. The fixture as recited in claim 1, wherein said first tangential wedge clamp and said second tangential wedge clamp for each vane includes a cylindrical portion receivable within said respective first and second apertures.

6. The fixture as recited in claim 1, wherein said first tangential wedge clamp and said second tangential wedge clamp flank a locator for each vane.

7. The fixture as recited in claim 6, wherein said locator receives an axial wedge clamp.

8. The fixture as recited in claim 7, further comprising a fastener receivable within said locator to bias said axial wedge clamp toward said locator.

9. The fixture as recited in claim 1, wherein said first tangential wedge clamp and said second tangential wedge clamp include a handle offset from an axis defined by a frustroconical portion.

10. A method of assembling a stator vane assembly of a gas turbine engine comprising the steps of:

positioning each of a multiple of vanes relative to an outer fairing and an inner fairing on a base which defines a multiple of locator planes;

receiving a first tangential wedge clamp in a first aperture located within the base for each of the multiple of vanes; and receiving a second tangential wedge clamp in a second aperture located within the base for each of the multiple of vanes.

11. The method as recited in claim 10, further comprising positioning each of the multiple vanes within a slot in the inner and outer fairing.

12. The method as recited in claim 11, further comprising injecting a curable material in each of the slots.

13. The method as recited in claim 10, further comprising defining a first locator plane, a second locator plane and a third locator plane for each of the multiple of vanes.

14. The method as recited in claim 10, further comprising defining a first locator plane with at least three (3) contact points, a second locator plane with at least two (2) contact points and a third locator plane with at least one (1) contact point.

15. The method as recited in claim 10, further comprising defining a first tangential locator plane with at least three (3) contact points, a second axial locator plane with at least two (2) contact points and a third radial locator plane with at least one (1) contact point.

16. The method as recited in claim 10, further comprising:

receiving the first tangential wedge clamp in the first aperture for each of the multiple of vanes such that the first tangential web clamp abuts one of the multiple of vanes; and receiving the second tangential wedge clamp in the second aperture for each of the multiple of vanes such that the second tangential web clamp abuts the one of the multiple of vanes.

17. The method as recited in claim 10, further comprising:

axially receiving the first tangential wedge clamp in the first aperture for each of the multiple of vanes such that the first tangential web clamp abuts one of the multiple of vanes; and axially receiving the second tangential wedge clamp in the second aperture for each of the multiple of vanes such that the second tangential web clamp abuts the one of the multiple of vanes.

* * * * *